US007444851B1

(12) United States Patent
Janson

(10) Patent No.: US 7,444,851 B1
(45) Date of Patent: Nov. 4, 2008

(54) HAND TOOL PROVIDING DOUBLE COMPOUND LEVERAGE TO THE JAWS

(76) Inventor: Paul M. Janson, 19151 Tulsa St., Northridge, CA (US) 91326

( * ) Notice: Subject to any disclaimer, the term of this patent is extended or adjusted under 35 U.S.C. 154(b) by 134 days.

(21) Appl. No.: 11/483,858

(22) Filed: Jul. 10, 2006

(51) Int. Cl.
*B25B 7/12* (2006.01)

(52) U.S. Cl. ..... 72/409.12; 81/348; 81/351; 81/363

(58) Field of Classification Search ..... 72/409.01, 72/409.18, 409.19, 409.12; 81/362, 363, 81/342, 347, 350, 351, 367; 29/270, 751, 29/268; 30/252, 192, 251
See application file for complete search history.

(56) References Cited

U.S. PATENT DOCUMENTS

| | | | | | |
|---|---|---|---|---|---|
| 832,804 | A * | 10/1906 | Oneal | 30/193 |
| 1,586,297 | A * | 5/1926 | Du Bios | 72/387 |
| 2,765,688 | A * | 10/1956 | Evans | 72/404 |
| 2,992,576 | A * | 7/1961 | Evans et al. | 72/409.08 |
| 5,307,565 | A * | 5/1994 | Erbrick et al. | 30/251 |
| 6,408,725 | B1 * | 6/2002 | Janson | 81/407 |

* cited by examiner

*Primary Examiner*—Daniel C Crane
(74) *Attorney, Agent, or Firm*—Timothy Thut Tyson; Ted Masters; Freilich, Hornbaker & Rosen

(57) ABSTRACT

A hand tool for use by one hand provides double compound leverage of the force exerted on the handles to the jaws. This is achieved by adding additional pivots and lever arms between the handles and the jaws. The jaws may take the form of a sheet metal snip, seamer, or crimper.

10 Claims, 4 Drawing Sheets

HAND TOOL PROVIDING DOUBLE COMPOUND LEVERAGE TO THE JAWS

TECHNICAL FIELD

The present invention pertains generally to hand tools, and more particularly to hand tools that are operated using one hand.

BACKGROUND OF THE INVENTION

Hand tools having two pivotally connected handles for moving jaws that a user operates with one hand are well known in the art. The basic tool has three parts: a unitary first member having a first handle on one end and a first jaw on the other, a unitary second member having a second handle on one end and a second jaw on the other, and an axle pivotally connecting the two together. Scissors and sheet metal snips are examples of such hand tools operated by one hand.

In many applications, the mechanical advantage offered by the simple leverage of three part hand tools is insufficient making it difficult or impossible to achieve the desired result with one hand. For example, cutting, crimping, and seaming sheet metal with a three part hand snipper, crimper, or seamer can require more hand pressure than the user can deliver, particularly when the cutting, crimping, or seaming must be performed over a protracted period of time.

One solution is to provide a compound lever action tool. FIGS. 1 and 2 illustrate side elevation views of such a prior art compound leverage hand tool 500 shown in the open and closed positions, respectively. Hand tool 500 is designed to be operated using one hand. Hand tool 500 has a first jaw member J1 and a second jaw member J2. The intermediate portions of jaw members J1 and J2 are pivotally connected at pivot P1. Hand tool 500 also has first handle member H1 and second handle member H2. One end of first handle member H1 is pivotally connected to an end of first jaw member J1 at pivot P2, and one end of second handle member H2 is pivotally connected to an end of second jaw member J2 a pivot P3. The intermediate portions of first handle member H1 and second handle member H2 are pivotally connected together at pivot P4. Pivots P2 and P3 are disposed between pivots P1 and pivot P4.

In the embodiment shown, first jaw member J1 and second jaw member J2 are shaped and dimensioned so that they combine to form a seamer, which is used to press material between the flat plates of first jaw member J1 and second jaw member J2. However, it may be appreciated that hand tools designed for other purposes such as cutting and crimping can also have the same compound leverage structural arrangement of pivots and levers. One such hand tool is the bolt cutter shown in U.S. Pat. No. 484,670 to H. K. Porter. It is noted in this tool that pivot P1 actually comprises two spread-apart pivots, yet the fundamental principle of the invention is the same as hand tool 500. It is further noted that hand tool 500 is designed to be used by one hand, whereas the tool of U.S. Pat. No. 484,670 is designed to be used by two hands.

FIG. 1 also shows the lever arms of hand tool 500. The tool provides compound leverage because it has two sets of levers. Lever arm A is the distance between the crotch of first jaw member J1 and pivot P1. Lever arm B is the distance between pivot P1 and pivot P2. Lever arm C is the distance between pivot P2 and pivot P4. Lever arm D is the distance between pivot P2 and the distal end of first handle member H1. Therefore the mechanical advantage MA of hand tool 500 is MA=(B/A)×(D/C). In the typical hand tool 500 shown, the length of the lever arms are about: A=0.5 inches, B=1.25 inches, C=0.8 inches, and D=5.25 inches. The mechanical advantage MA is therefore MA=(1.25/0.5)×(5.25/0.8)=about 16.4 which is generally referred to as 16.4 to 1.

Additional mechanical advantage can be achieved by adding an additional set of levers to provide the tool with double compound leverage. U.S. Pat. No. 1,348,735 also by H. K. Porter is an example of such a tool. The handles pivot together to provide leverage. The jaws pivot together to compound the leverage provided by the handles. Intermediate links pivot together to doubly compound the leverage provided by the handles. This tool is designed to be used by two hands.

Snippers, crimpers, and seamers having only simple leverage for use by one hand may be satisfactory for work on sheet metal and other applications where the material is very thin and the work to be done does not extend over a long period of time. Snippers, crimpers, and seamers having compound leverage for use by one hand such as tool 500 above may be satisfactory for work on sheet metal and other applications where the material is somewhat thicker. But there are other situations where snippers, crimpers, and seamers having double compound leverage for use by one hand would be advantageous both to work thicker materials and perform the work over longer periods of time and these are not available.

BRIEF SUMMARY OF THE INVENTION

The present invention is directed to a hand tool that has an increased mechanical advantage. The hand tool of the present invention includes additional pivots and lever arms that increase the mechanical advantage of the hand tool, and make the tool easier to operate with one hand. This is accomplished by adding center members between the jaw members and handle members to doubly compound the leverage provided by the handles on the jaws.

In accordance with a preferred embodiment of the invention, a hand tool includes first and second jaw members that are pivotally connected to first and second center members that in turn are pivotally connected to first and second handle members. In all the hand tool of the present invention includes six members that are connected at seven pivot points. This is in contrast to prior art tools for use by one hand that have four members connected at four pivot points. The jaws of the present invention can be adapted to perform a variety of tasks such as cutting, seaming, or crimping sheet metal, cutting vegetation, and other uses.

In accordance with one aspect of the present invention, the overall length of the tool is decreased by placing the pivot for the handles between the pivot for the first and second center members and the pivots connecting the center members to the handles.

In accordance with another aspect of the present invention, the pivots for each of the center members are outside of the pivot between the center members.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
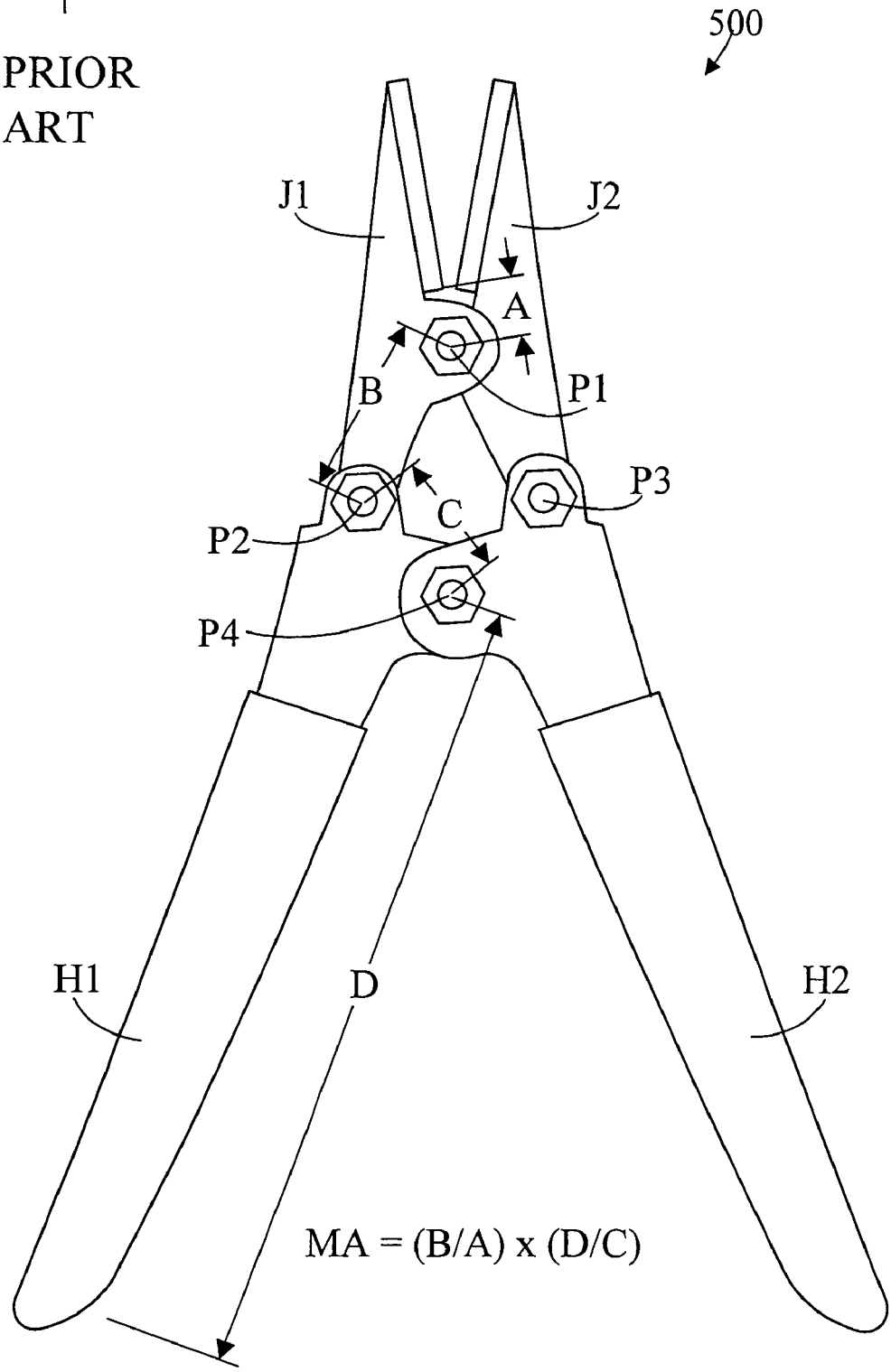
Fig. 1 PRIOR ART
FIG. 1 is a side elevation view of a prior art hand tool shown in the open position.
Figure 2:
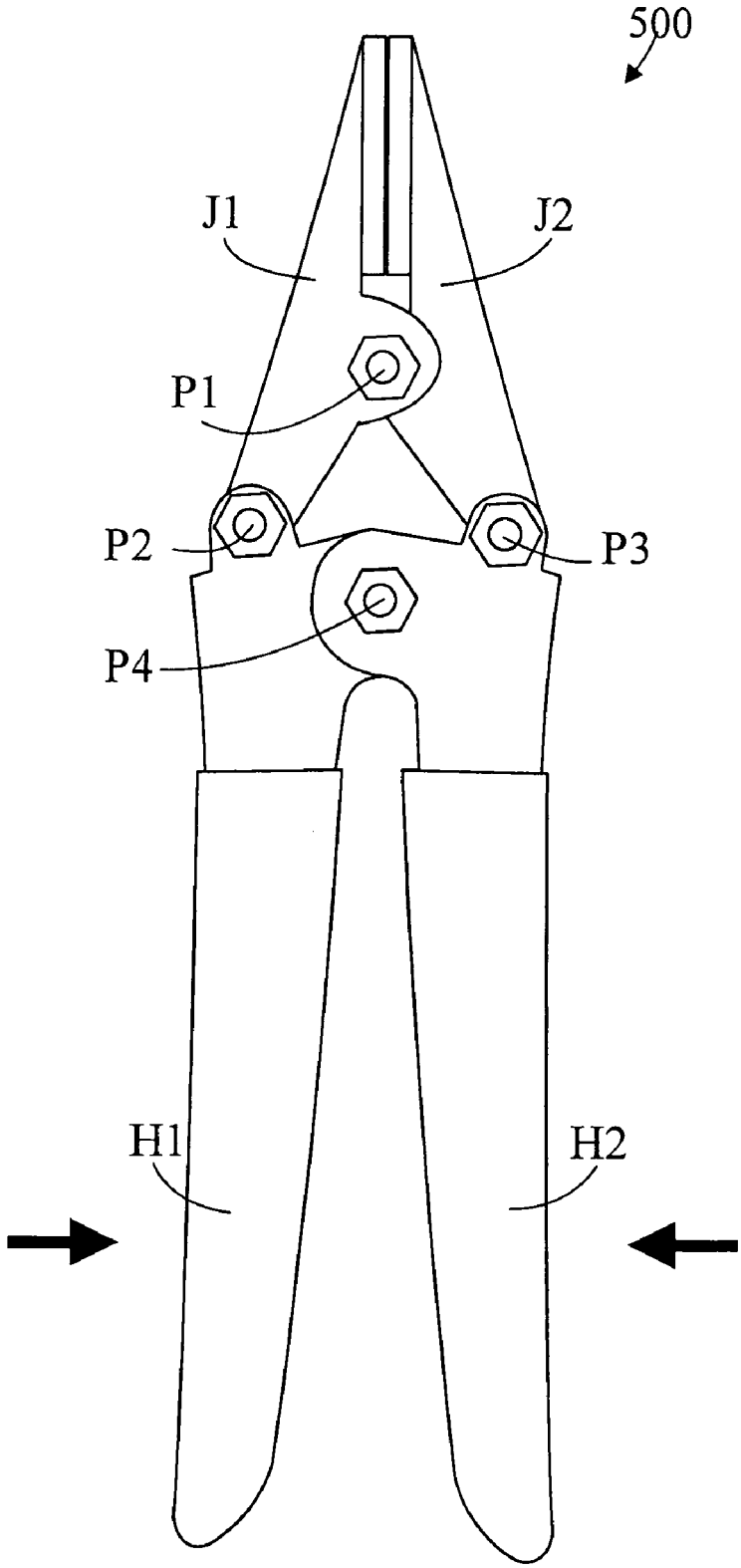
Fig. 2 PRIOR ART
FIG. 2 is a side elevation view of the prior art hand tool shown in the closed position.
Figure 3:
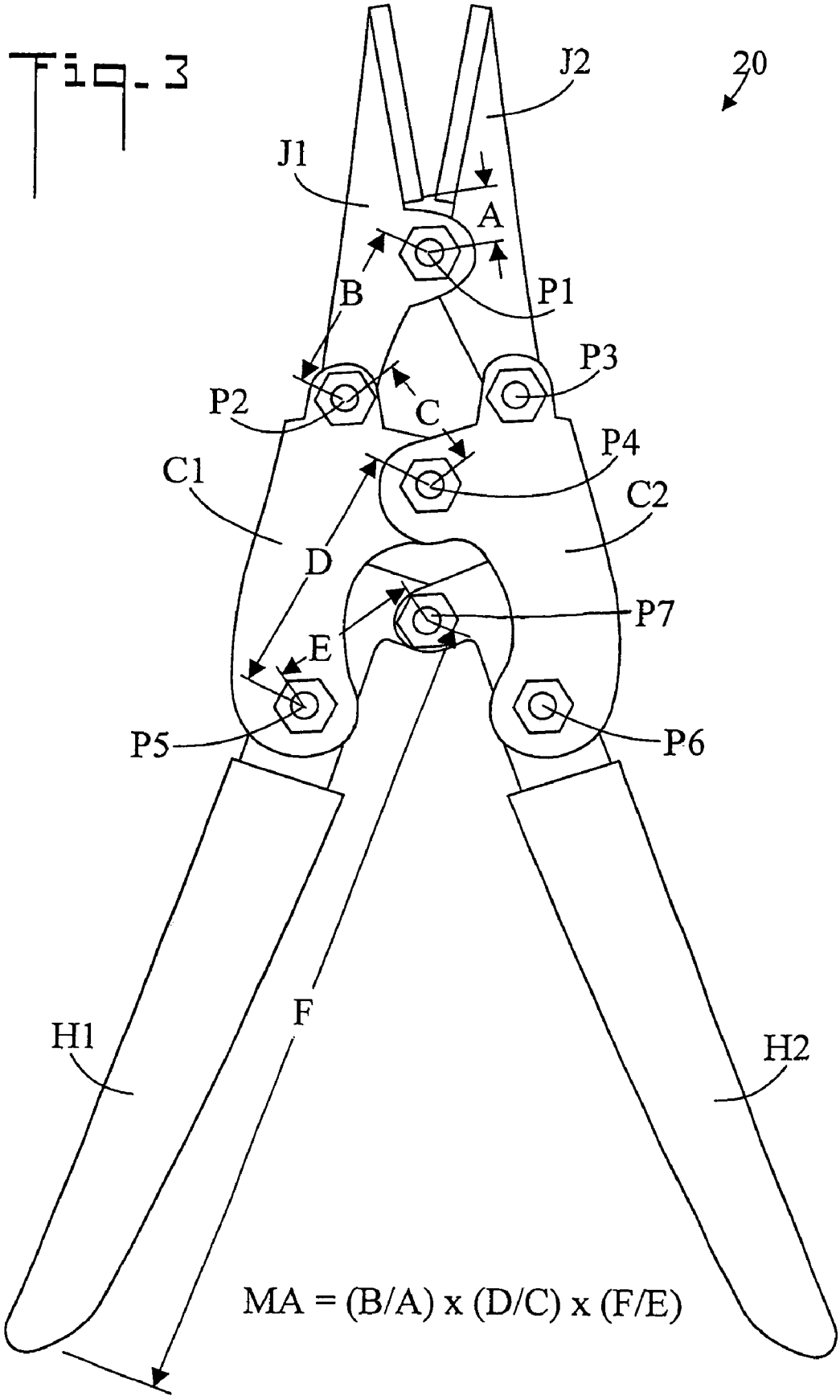
FIG. 3 is a side elevation view of the hand tool of the present invention shown in the open position; and, FIG. 4 is a side elevation view of the hand tool of the present invention shown in the closed position.
Figure 4:
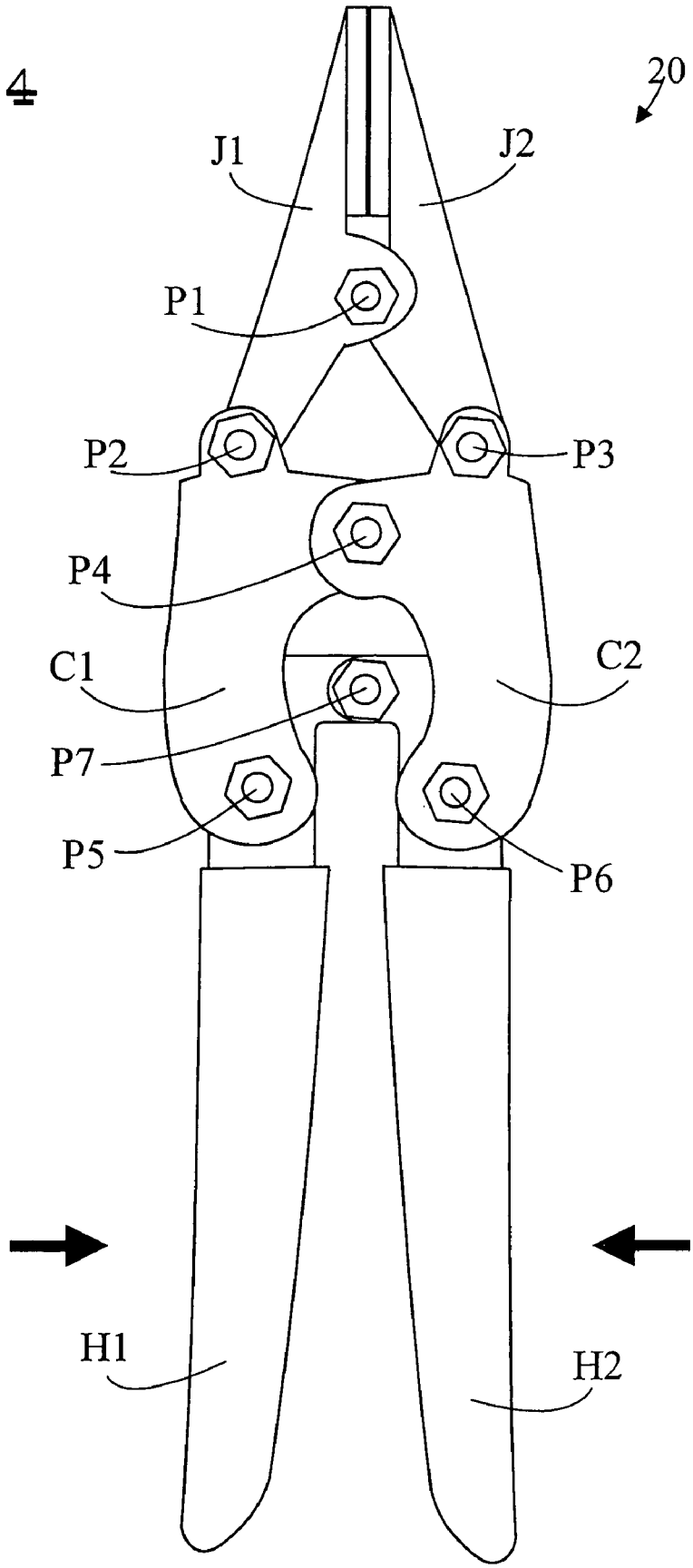

FIGS. 3 and 4 illustrate side elevation views of a hand tool 20 in accordance with the present invention shown in the open and closed positions, respectively. Hand tool 20 includes a first jaw member J1 and a second jaw member J2. The intermediate portions of jaw members J1 and J2 are pivotally connected at pivot P1. Hand tool 20 also includes first center member C1 and second center member C2. One end of first center member C1 is pivotally connected to first jaw member J1 at pivot P2, and one end of second center member C2 is pivotally connected to second jaw member J2 at pivot P3. The intermediate portions of first center member C1 and second center member C2 are pivotally connected together at pivot P4.

Hand tool 500 also has first handle member H1 and second handle member H2. An intermediate portion of first handle member H1 is pivotally connected to the opposite end of center member C1 at P5, and an intermediate portion of second handle member H2 is pivotally connected to the opposite end of second center member C2 at P6. The end portions of first handle member H1 and second handle member H2 are pivotally connected together at pivot P7. It is noted that pivot P7 is disposed above pivots P5 and P6.

FIG. 3 also shows the various lever arms of hand tool 20. Lever arm A is the distance between the crotch of first jaw member J1 and pivot P1. Lever arm B is the distance between pivot P1 and pivot P2. Lever arm C is the distance between pivot P2 and pivot P4. Lever arm D is the distance between pivot P4 and pivot P5. Lever arm E is the distance between pivot P5 and pivot P7. Lever arm F is the distance between pivot P7 and the distal end of first handle member H1. Therefore the mechanical advantage MA of hand tool 20 is MA=(B/A)×(D/C)×(F/E). In the typical hand tool 20 shown the length of the lever arms are about, A=0.5 inches, B=1.25 inches, C=0.8 inches, D=1.9 inches, E=1.1 inches, and F=6.25 inches. The mechanical advantage MA is therefore MA=(1.25/0.5)×(1.9/0.8)×(6.25/1.1)=about 33.74 which is generally referred to as 33.74 to 1. It is therefore observed that the mechanical advantage MA of the present invention 20 is substantially greater than the mechanical advantage MA of prior art hand tool 500 (33.74 vs. 16.4).

The preferred embodiments of the invention described herein are exemplary and numerous modifications, variations, dimensional variations, and rearrangements can be readily envisioned to achieve an equivalent result, all of which are intended to be embraced within the scope of the appended claims.

I claim:

1. A hand tool, comprising:

a first jaw member having a first end, an opposite second end, and an intermediate portion;

a second jaw member having a first end, an opposite second end, and an intermediate portion;

said intermediate portion of said second jaw member pivotally connected to said intermediate portion of said first jaw member at a first pivot P1;

a first center member having a first end, an opposite second end, and an intermediate portion, said first center member connected at exactly three pivot points, said first end of said first center member pivotally connected to said second end of said first jaw member at a second pivot P2;

a second center member having a first end, an opposite second end, and an intermediate portion, said second center member connected at exactly three pivot points, said first end of said second center member pivotally connected to said second end of said second jaw member at a third pivot P3;

said intermediate portion of said first center member pivotally connected to said intermediate portion of said second center member at a fourth pivot P4, a first handle member having a first end, an opposite second end, and an intermediate portion, said intermediate portion of said first handle member pivotally connected to said second end of said first center member at a fifth pivot P5, said three pivot points on said first center member comprising said second pivot P2, said fourth pivot P4 and said fifth pivot P5, all three pivot points fixed relative to one another;

a second handle member having a first end, an opposite second end, and an intermediate portion, said intermediate portion of said second handle member pivotally connected to said second end of said second center member at a sixth pivot P6, said three pivot points on said second center member comprising said third pivot P3, said fourth pivot P4 and said sixth pivot P6, all three pivot points fixed relative to one another;

said first end of said first handle member pivotally connected to said first end of said second handle member at a seventh pivot P7, wherein said seventh pivot P7 is disposed between (1) said fourth pivot P4, and (2) said fifth and sixth pivots P5 and P6; and, said fourth pivot P4 disposed between (1) said second and third pivots P2 and P3, and (2) said seventh pivot P7.

2. The hand tool of claim 1, further including:

said jaw members having a crotch therebetween;

a lever arm A being the distance between said crotch of said jaw members and said first pivot P1;

a lever arm B being the distance between said first pivot P1 and said second pivot P2;

a lever arm C being the distance between said second pivot P2 and said fourth pivot P4;

a lever arm D being the distance between said fourth pivot P4 and said fifth pivot P5;

a lever arm E being the distance between said fifth pivot P5 and said seventh pivot P7;

a lever arm F being the distance between said seventh pivot P7 and said second end of said first handle member; and, a mechanical advantage MA of said hand tool being MA=(B/A)×(D/C)×(F/E).

3. The hand tool of claim 1, further including said first jaw member and said second jaw member combining to form a sheet metal seamer.

4. The hand tool of claim 1, further including:

said first jaw member, said second jaw member, said first center member, and said second center member each being a single member.

5. The hand tool of claim 1, further including:

said seventh pivot P7 being approximately equidistant from each of said fourth pivot P4, said fifth pivot P5, and said sixth pivot P6.

6. In a hand tool of the type having (a) a first jaw member having a first end, an opposite second end, and an intermediate portion, (b) a second jaw member having a first end, an opposite second end, and an intermediate portion, (c) the intermediate portion of the first jaw member pivotally connected to the intermediate portion of the second jaw member at a first pivot P1, (d) a first handle member having a first end, an opposite second end, and an intermediate portion, (e) a second handle member having a first end, an opposite second end, and an intermediate portion, (f) the first end of the first handle member pivotally connected to the first end of the second handle member at a seventh pivot P7, the improvement comprising:

a first center member having a first end, an opposite second end, and an intermediate portion, said first center member connected at exactly three pivot points, said first end of said first center member pivotally connected to the second end of the first jaw member at a second pivot P2;

a second center member having a first end, an opposite second end, and an intermediate portion, said second center member connected at exactly three pivot points, said first end of said second center member pivotally connected to the second end of the second jaw member at a third pivot P3;

said intermediate portion of said first center member pivotally connected to said intermediate portion of said second center member at a fourth pivot P4;

said second end of said first center member pivotally connected to the intermediate portion of the first handle member at a fifth pivot P5;

said second end of said second center member pivotally connected to the intermediate portion of the second handle member at a sixth pivot P6, wherein the seventh pivot P7 is disposed between (1) said fourth pivot P4, and (2) said fifth and sixth pivots P5 and P6;

said fourth pivot P4 disposed between (1) said second and third pivots P2 and P3, and the seventh pivot P7 said three pivot points on said first center member comprising said second pivot P2, said fourth pivot P4 and said fifth pivot P5, all three pivot points fixed relative to one another; and said three pivot points on said second center member comprising said third pivot P3, said fourth pivot P4 and said sixth pivot P6, all three pivot points fixed relative to one another.

7. The hand tool of claim 6, further including:

the jaw members having a crotch therebetween;

a lever arm A being the distance between the crotch of the jaw members and the first pivot P1;

a lever arm B being the distance between the first pivot P1 and said second pivot P2;

a lever arm C being the distance between said second pivot P2 and said fourth pivot P4;

a lever arm D being the distance between said fourth pivot P4 and said fifth pivot P5;

a lever arm E being the distance between said fifth pivot P5 and the seventh pivot P7;

a lever arm F being the distance between the seventh pivot P7 and the second end of the first handle member; and, a mechanical advantage MA of said hand tool being $MA=(B/A)\times(D/C)\times(F/E)$.

8. The hand tool of claim 6, further including the first jaw member and the second jaw member combining to form a sheet metal seamer.

9. The hand tool of claim 6, further including:

said first jaw member, said second jaw member, said first center member, and said second center member each being a single member.

10. The hand tool of claim 6 further including:

said seventh pivot P7 being approximately equidistant from each of said fourth pivot P4, said fifth pivot P5, and said sixth pivot P6.

* * * * *